United States Patent [19]

Strohmeyer, Jr.

[11] Patent Number: 4,506,608

[45] **Date of Patent: * Mar. 26, 1985**

[54] UNFIRED DRYING AND SORTING APPARATUS FOR PREPARATION OF SOLID FUEL AND OTHER SOLID MATERIAL

[75] Inventor: Charles Strohmeyer, Jr., Gladwyne, Pa.

[73] Assignee: Electrodyne Research Corp., Gladwyne, Pa.

[ * ] Notice: The portion of the term of this patent subsequent to May 22, 2001 has been disclaimed.

[21] Appl. No.: 595,519

[22] Filed: Mar. 30, 1984

Related U.S. Application Data

[63] Continuation-in-part of Ser. No. 464,062, Feb. 3, 1983, Pat. No. 4,449,483.

[51] Int. Cl.[3] ..... F23G 5/00

[52] U.S. Cl. ..... 110/245; 122/4 D; 122/1 A

[58] Field of Search ..... 110/245; 122/4 D, 1 A; 431/170; 432/58

[56] References Cited

U.S. PATENT DOCUMENTS

| | | | |
|---|---|---|---|
| 2,803,439 | 8/1957 | Fikenscher | 122/1 A |
| 3,605,655 | 9/1971 | Warshawsky et al. | 122/4 D |
| 4,273,073 | 6/1981 | Robinson | 122/4 D |
| 4,324,544 | 4/1982 | Blake | 110/245 |
| 4,329,324 | 5/1982 | Jones | 110/245 |
| 4,349,969 | 9/1982 | Stewart et al. | 122/4 D |
| 4,434,723 | 3/1984 | Brealey et al. | 122/4 D |
| 4,442,796 | 4/1984 | Strohmeyer | 122/4 D |
| 4,449,483 | 5/1984 | Strohmeyer | 122/4 D |
| 4,452,180 | 6/1984 | Hassan | 122/1 A |

*Primary Examiner*—Henry C. Yuen

*Attorney, Agent, or Firm*—William J. Ruano

[57] ABSTRACT

The invention comprising a drying and sorting apparatus for preparation of solid fuel and other solid materials having substantial surface moisture. Ambient air/gas is preheated by indirect heat exchange or other unfired means sufficiently to provide heat needed by the downstream process. The air/gas is then passed up vertically through a bed containing the solid materials, heating and fluidizing them along with the surface moisture. When in a fluidized state, the smaller/lower density particles rise to the top of the bed. At least a portion of the surface moisture on the particles is evaporated. The quantity and temperature of the air/gas flow is sufficient to retain the evaporated surface moisture in the vapor phase. Feedstock of solid materials is added to an intermediate location of the bed. The larger/more dense fluidized particles are removed from bottom location/s of the bed. The smaller/less dense fluidized particles are removed from top location/s of the bed. The temperature and vapor holding capacity of the air/gas leaving the bed is substantially higher than at ambient conditions. The air/gas is again heated by indirect or unfired means downstream of the bed for reducing relative humidity of the air/gas substantially below saturation prior to passage through a bag house for fine particle collection after which the air/gas along with the superheated water vapor is discharged to atmosphere. An optional mechanical solids separator can be installed between the bed and after bed heater.

6 Claims, 1 Drawing Figure

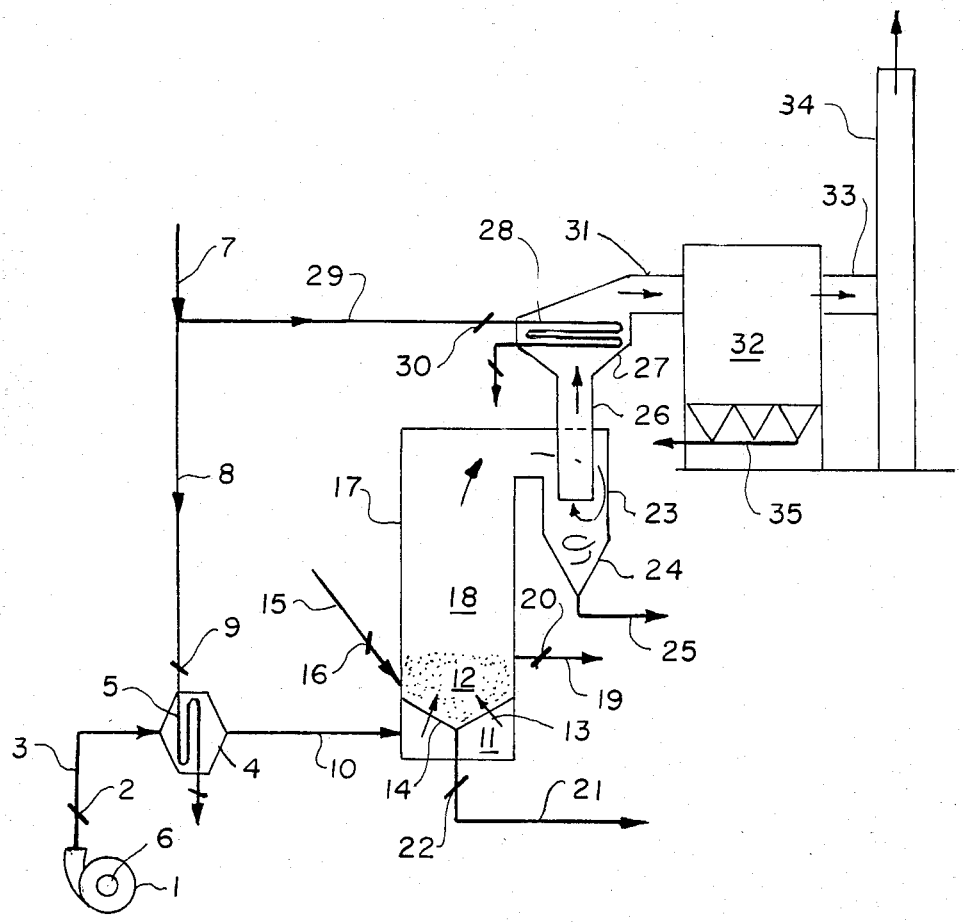
34
33
28
31
7
29
32
30
27
26
8
17
23
35
24
15
18
20
9
25
16
12
19
5
13
3
4
10
11
2
14
21
6
22
1

UNFIRED DRYING AND SORTING APPARATUS FOR PREPARATION OF SOLID FUEL AND OTHER SOLID MATERIAL

This invention relates to improved means for utilization of solid fuels or other materials where separation of foreign matter, sizing or moisture content of the material has an influence upon the effective utilization of the material. The sorting, sizing and drying apparatus employs fluidized bed principles using air/gas as the fluidizing and drying medium.

The denser/larger particles settle to the lower portion of the fluidized bed and the less dense/smaller particles rise to the upper portion of the bed. Unsaturated air/gas passing through the bed removes surface moisture through evaporation.

This invention is a continuation-in-part of U.S. patent application Ser. No. 464,062 filed Feb. 3, 1983, now U.S. Pat. No. 4,449,483.

In the present invention the fluidized bed is of the unfired type and is used for sorting purposes to separate the more dense particles from the less dense particles or to classify the solid material by particulate size. Unsaturated air/gas is admitted to the bed in a distributed manner after preheating and sufficient to supply the required heat for the processing action in the fluidized bed. The air/gas is then passed up vertically through the bed containing the solid materials, heating and fluidizing them along with the surface moisture. When in a fluidized state, the smaller/lower density particles rise to the top of the bed. At least a portion of the surface moisture on the particles is evaporated. The quantity and temperature of the air/gas flow is sufficient to retain the evaporated surface moisture in the vapor phase. Feedstock of solid materials is added at an intermediate location of the bed. The larger/more dense fluidized particles are removed from bottom location/s of the bed. The smaller/less dense fluidized particles are removed from top location/s of the bed. The temperature and vapor holding capacity of the air/gas leaving the bed is substantially higher than at ambient conditions. The air/gas is again heated by indirect means downstream of the bed for reducing relative humidity of the air/gas substantially below saturation prior to passage through a bag house for fine particle collection after which the air/gas along with the superheated water vapor is discharged to atmosphere. An optional mechanical solids separator can be installed between the bed and after bed heater.

In the past material was sized by passing the material over mesh screens having a specific size of openings for the material to drop through. Density separation was accomplished through heavy media separation and drying was accomplished by exposure of the wetted materials to hot combustion gases. The present invention combines such functions in an apparatus having new and unique structural and operational characteristics.

For the apparatus and systems described herein, a specific object of this invention is to provide a means for separation of more dense/larger solid material particulate from less dense/smaller solid material particulate utilizing unfired fluidized bed principles.

A further object is to dry said solid material during the separation process.

A still further object is to provide a means to separate and collect solid particles entrained in the air/gas stream used for fluidizing the bed at a location downstream of the bed.

A still further object is to preheat the air/gas used for fluidizing the bed sufficiently to provide the required heat for the in-bed separation and drying process.

A still further object is to postheat the fluidizing air/gas leaving the fluidized bed before passage through a fabric filter type bag house for fine particle removal and subsequent discharge to atmosphere through a stack.

The invention will be described in detail with reference to the accompanying drawings wherein:

FIG. 1 is a sectional diagramatic arrangement of the unfired drying and sorting apparatus.

On FIG. 1 fluidizing air fan 1 pressurizes atmospheric air at ambient temperature to approximately 58" Wg and discharges through isolation damper 2 and conduit 3 to air plenum 4 in which steam coil airheater 5 is located. Inlet vanes 6 at fan 1 inlet control air supply to fan 1 and rate of air flow to conduit 3.

Process steam is supplied through conduit 7 and 8 to steam coil 5. Throttling means 9 regulates steam flow rate to coil 5. Steam coil 5 heats the effluent air in conduit 10 sufficiently to support the process requirements of fluidized bed 12. Duct 10 discharges to plenum 11. Heated air in plenum 11 flows through ports 13 in floor 14 to and through bed 12. Ports 13 are uniformly distributed over floor 14.

A feedstock of solid particles flows into bed 12 through conduit 15 and flow control means 16 at an intermediate location.

Bed 12 is contained in vessel chamber 17 incorporating a plenum 18 over bed 12. Less dense/smaller solid particles are removed through conduit 19 and flow control means 20. More dense/larger solid particles are removed through conduit 21 and flow control means 22.

Plenum 18 discharges to cyclone separator 23 where fine particles are collected in hopper 24 and withdrawn through conduit 25. The air/gas ladden with water vapor is withdrawn through conduit 26 to plenum 27 in which steam coil air heater 28 is located.

Process steam from conduit 7 is also supplied to steam coil 28 through conduit 29 and flow control means 30. Steam coil 28 heats the air/gas and water vapor passing through from conduit 26 to conduit 31 lowering the relative humidity of the air/gas and raising the superheat of the entrained vapor.

Conduit 31 discharges through the fabric filter type bag house 32 which separates the fine solids from the gas stream so that the effluent in duct 33 and stack 34 conforms to environmental standards as it discharges to atmosphere. Other means of collection could be substituted for the bag house as an electrostatic precipitator.

Dust collected in bag house 32 is removed through conduit system 35.

For the case illustrated, a mixture of coal and heavier inert material is fed through conduit 15 to bed 12. The less dense coal is removed through conduit 19. The inert material including slate is removed through conduit 21.

Other solid removal points may be located at various levels between points 19 and 21.

Approximately 4483 lb of ambient air are required for fluidizing, heating and vapor transit per ton of feedstock processed to remove a surface moisture content of 10 percent.

Ambient air is heated to approximately 370 F. passing through steam coils 5. Process steam to the coils is 200 psig or greater. Pressure drop through the bed 12 is in a range of 40" Wg. Air/gas velocity through the bed 12 is in a range of 8 ft./sec.

The heat in the air/gas entering the bed 12 through ports 13 should be sufficient to maintain an air/gas temperature of about 120 F. at the bed 12 outlet. A range of from 110 F. to 150 F. is considered optimal.

The air/gas and water vapor in conduit 26 is postheated by steam coil 28 to about 160 F. leaving coil 28. This reduces the relative humidity from near 100 percent to about 27 percent as the air/gas enters baghouse 32. This assures passage of the water-vapor through baghouse 32 leaving the solid particulate residue on the bags in a dry state for removal through conduit 35.

An air/gas temperature increase across steam coil 28 in a range of from 20 F. to 112 F. is considered optimal.

Steam coil 28 receives process steam at 200 psig from conduit 29.

Air/gas is used to both fluidized the solids in bed 12 and heat and vaporize the surface moisture on the bed solids. The fluidizing air/gas transports the water vapor away from the bed for discharge to atmosphere. The course fines are separated in cyclone 23.

The water vapor in conduit 27 is superheated by steam coil 28 to permit free passage of the moisture through bag house 32 filters for exhaust to atmosphere through stack 34.

The sorting and drying process is accomplished at lower temperature. Stack losses are minimized. Heavy density inert solids can be removed through conduit 21 and less dense active fuel removed through conduit 19. Where various size particles of the same material are fed through conduit 15 as feedstock on a continuing basis, the larger sized particles are removed through conduit 21 and smaller sized particles are removed througn conduit 19. In between sized particles can be removed from additional points between points 19 and 21.

The degree of drying can be controlled by the temperature and mass flow rate of the air/gas supply in conduit 10 to bed 12. Air/gas mass flow rates will vary plus and minus 50 percent to suit the specific characteristics of the material processed. The same applies to the air/gas supply temperature to bed 12. The steam pressure need only be adequate to realize the required heat transfer rates. Steam coil 5 is governing. Density of the solids processed will influence the depth of the bed, pressure drop through the bed, and air/gas velocity through the bed which can be tolerated. The outlet air/gas temperature of bed 12 is a measure of the vapor content leaving the bed. The temperature increase across coil 28 assures non-clogging performance for bag house 32.

Thus, it will be seen that I have provided an efficient embodiment of my invention whereby means are provided for separation of more dense/larger material particles from less dense/smaller solid particles utilizing unfired fluidized bed principles, solid material is dried during the separation process, solid particles entrained in the air/gas stream used for fluidizing purposes are collected downstream of the bed, the air/gas is preheated before admission to the bed for conveyance of process heat to the bed, and postheating downstream of the bed before passage of the air/gas through a bag house or equivalent permits free passage of the water vapor to atmosphere.

While I have illustrated and described various embodiments of my invention, these are by way of illustration only and various changes and modifications may be made within the contemplation of my invention and within the scope of the following claim:

I claim:

1. An unfired drying and sorting apparatus for preparation of solid fuel and other material incorporating:

a fluidized bed consisting of a mixture of moisture bearing solid particles of fuel and other material suspended in a vertical chamber and supported by a floor;

ports in said floor for receiving a continuous supply of pressurized and heated air for fluidizing said bed;

means for continuously supplying unsaturated and pressurized air to said ports at a variable and preselected flow rate;

first steam coil air heater for heating said pressurized air upstream of said ports;

means for selective control of steam supply to said first steam coil air heater;

means for continuously feeding said moisture bearing solid particles to said bed;

means for continuously removing said solid particles from said bed after retention in said bed for some period of time, retention providing time for drying of said solid particles;

means for continuously removing air and vapor generated from said moisture at the outlet of said vertical chamber;

first regulatory means including said means for air supply to said ports at a predetermined flow rate and said means for selective control of steam supply to said first steam coil air heater adapted for maintaining said air and vapor temperature exhausting from said bed in a range of from 100 F. to 150 F. to regulate the degree of moisture removal from said fuel and other material for maintaining the residual moisture in said fuel and other material at a predetermined quantity;

a baghouse filter type or equivalent solids collector connected to said vertical chamber outlet means and including a second steam coil air heater for post-heating said air and vapor discharging from said outlet means before entry to said collector, and second regulatory means for selective control of steam supply to said second steam coil heater and adapted for maintaining said air and vapor temperature at said second heater outlet at a predetermined value in a range of 20 F. to 112 F. above said air and vapor saturated temperature exhausting from said bed, said post-heating superheating said air and vapor and enabling free passage of said air and vapor through said baghouse without fouling as a result of wetted solid formation on said baghouse collector filters.

2. An apparatus as recited in claim 1 and wherein:

said means for continuously removing said solid particles from said bed comprising a first means for removal of a more dense/larger sized portion of said solid particles from a lower portion of said bed, and a second means for removal of a less dense/smaller sized portion of said solid particles from a top/intermediate portion of said bed.

3. An apparatus as recited in claim 1 and including:

means connected to said vertical chamber air and vapor removal means for separating particles entrained in said air and vapor exiting from said vertical chamber by centrifugal action in said air and vapor gas path upstream of said second steam coil heater.

4. A process for an unfired drying and sorting apparatus for preparation of solid fuels and other materials which comprises the steps of:

coordinating the integrated process;

introducing a continuous supply of moisture bearing solid particles of fuel and other materials into a fluidized bed in a vertical chamber;

pressurizing a stream of unsaturated fluidizing air and preheating said air stream by passing said air stream through a first steam coil air heater;

introducing said stream of fluidizing air up through the bottom of said bed;

continuously removing said solid particles from said bed after retention in said bed for some period of time, retention providing time for drying of said solid particles;

regulating the degree of moisture removal from said solid fuel and other material for maintaining the residual moisture in said fuel and other material at a predetermined value by selective adjustment of the rate of flow of the fluidizing air stream along with selective adjustment of the rate of steam flow to the steam coil air heater while maintaining temperature of said air and vapor exhausting from said bed in a range of from 110 F. to 150 F.:

withdrawing said air and vapor exiting from said bed and passing said air and vapor mixture through a second steam coil air heater;

adjusting steam supply to said second steam coil heater to maintain temperature of said air and vapor mixture exhausting from said second steam coil heater in a range of from 20 F. to 112 F. above said air and vapor saturated temperature exhausting from said bed; and passing said air and vapor exiting from said second steam coil heater through a baghouse filter type or equivalent solids collector for ultimate removal of solids from said air and vapor stream, said second steam coil superheating said air and vapor and enabling free passage of said air and vapor through said baghouse without fouling from wetted solids carried along in said air and vapor stream.

5. The process as defined in claim 4, wherein said step of removing said solid dried particles from said bed comprises both removing the more dense/larger sized portion from a lower portion of said bed and removing the less dense/smaller sized portion from a top/intermediate portion of said bed.

6. The process as defined in claim 4 further comprising the step of separating solid particles in said air and vapor stream after said bed and before said second steam coil heater through centrifugal action in said air and vapor stream.

* * * * *